US007086713B2

(12) United States Patent
Triplett

(10) Patent No.: US 7,086,713 B2
(45) Date of Patent: Aug. 8, 2006

(54) MEDIA DETACK FROM AN INTERMEDIATE PRINTING MEMBER

(75) Inventor: Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/408,502

(22) Filed: Aug. 5, 2003

(65) Prior Publication Data

US 2005/0030362 A1 Feb. 10, 2005

(51) Int. Cl.
*B41J 29/38* (2006.01)

(52) U.S. Cl. ..... 347/16

(58) Field of Classification Search ..... 347/16, 347/37, 101–105, 213, 228, 262, 264, 153–154; 346/140.1; 399/302–304, 308; 430/45
See application file for complete search history.

(56) References Cited

U.S. PATENT DOCUMENTS

| | | | | |
|---|---|---|---|---|
| 746,124 | A | 12/1903 | Mosher | |
| 3,252,163 | A | 5/1966 | Yedinak et al. | 346/136 |
| 3,923,298 | A | 12/1975 | Ishida | 271/312 |
| 4,000,942 | A | 1/1977 | Ito et al. | 399/398 |
| 4,013,285 | A | 3/1977 | Green et al. | 271/261 |
| 4,014,538 | A | 3/1977 | Akiyama et al. | 271/176 |
| 4,401,982 | A | 8/1983 | Miyazaki et al. | 345/47 |
| 4,579,441 | A | 4/1986 | Hart et al. | 399/315 |
| 4,961,090 | A | 10/1990 | Gray, Jr. et al. | 355/50 |
| 4,962,389 | A * | 10/1990 | Kan et al. | 346/140.1 |
| 5,187,526 | A * | 2/1993 | Zaretsky | 399/302 |
| 5,553,806 | A | 9/1996 | Lucas | 242/542.4 |
| 5,634,404 | A | 6/1997 | Okuda | 101/477 |
| 5,710,964 | A * | 1/1998 | Tombs et al. | 399/303 |
| 5,777,658 | A | 7/1998 | Kerr et al. | 347/215 |
| 5,971,393 | A | 10/1999 | Vernackt | 271/276 |
| 6,023,282 | A | 2/2000 | Garand et al. | 347/172 |
| 6,049,393 | A | 4/2000 | Knierim et al. | 358/1.2 |
| 6,075,965 | A * | 6/2000 | Tombs et al. | 399/308 |
| 6,077,636 | A * | 6/2000 | Moriki et al. | 430/45 |
| 6,120,143 | A | 9/2000 | Narushima et al. | 347/104 |
| 6,135,591 | A | 10/2000 | Ikeda et al. | 347/104 |
| 6,149,262 | A | 11/2000 | Shiida et al. | 347/37 |
| 6,167,229 | A | 12/2000 | Wantanabe et al. | 399/313 |
| 6,169,557 | B1 | 1/2001 | Suzuki et al. | 347/104 |
| 6,219,081 | B1 | 4/2001 | Sasaki et al. | 347/213 |
| 6,234,597 | B1 | 5/2001 | Suzuki et al. | 347/7 |
| 6,247,809 | B1 | 6/2001 | Kashiwagi et al. | 347/104 |
| 6,549,745 | B1 * | 4/2003 | May et al. | 399/302 |
| 6,736,500 | B1 * | 5/2004 | Takahashi et al. | 347/103 |

FOREIGN PATENT DOCUMENTS

| | | |
|---|---|---|
| JP | 06274046 A | 9/1994 |
| JP | 411334916 A | 12/1999 |

* cited by examiner

*Primary Examiner*—Hai Pham
(74) *Attorney, Agent, or Firm*—Taylor & Aust, P.C.

(57) ABSTRACT

An inkjet printer for printing on a print medium having an obverse side and a reverse side, including a rotating intermediate transfer member for receiving a print image and transferring the print image to the obverse side of the print medium and a rotating drag force applicator located proximate to and defining a nip with the intermediate transfer member, the drag force applicator being configured for applying a drag force to the reverse side of the print medium in the nip.

31 Claims, 3 Drawing Sheets

MEDIA DETACK FROM AN INTERMEDIATE PRINTING MEMBER

BACKGROUND OF THE INVENTION

1. Field of the Invention.

The present invention relates to a method and an apparatus for detacking a print media from a transfer member, and, more particularly, to a method and an apparatus for detacking a print media from an intermediate printing member in a printer.

2. Description of the Related Art

A printer can include an intermediate transfer device, which transfers text and/or images therefrom to a print medium. An ink jet printer can contain an intermediate transfer member in the form of an intermediate transfer drum. To prepare for the image transfer process a coating assembly places a coating of fluid or gel onto a surface of the intermediate transfer drum. This fluid or gel has some degree of tackiness to it. A printhead is located proximate to the circumference of the intermediate transfer drum and an image is delivered to the fluid/gel layer by the printhead. The ink that is applied to the fluid/gel layer also has some degree of tackiness to it. As a sheet of print media enters into the transfer nip, formed by the intermediate transfer drum and backing roll, the media contacts the ink/gel and becomes adhered to the surface of the intermediate transfer drum. If the media is not detacked from the drum, it can wrap around the surface of the drum, causing a jam or other problems in the printer.

A common method of detacking the print media from an intermediate transfer drum includes the use of detack fingers positioned across the width of the transfer drum. The detack fingers ride on the surface of the intermediate transfer drum and peel the print media off of the drum. A problem with peeling the print media from a transfer drum, is that it often causes smears on the printed image.

What is needed in the art is a method to detack a print media from an intermediate transfer drum without contacting the printed image.

SUMMARY OF THE INVENTION

The present invention provides an apparatus and method for detacking print media from an intermediate printing drum.

The invention comprises, in one form thereof, an inkjet printer for printing on a print medium having an obverse side and a reverse side, including a rotating intermediate transfer member for receiving a print image and transferring the print image to the obverse side of the print medium and a rotating drag force applicator located proximate to and defining a nip with the intermediate transfer member, the drag force applicator being configured for applying a drag force to the reverse side of the print medium in the nip.

The invention comprises, in another form thereof, an imaging system including a computer, a printer communicatively connected to the computer. The printer being configured for printing on a print medium having an obverse side and a reverse side, including a rotating intermediate transfer member for receiving a print image and transferring the print image to the obverse side of the print medium and a rotating drag force applicator located proximate to and defining a nip with the intermediate transfer member, the drag force applicator being configured for applying a drag force to the reverse side of the print medium in the nip.

The invention comprises, in yet another form thereof, a method of detacking a print media from an intermediate transfer drum in an ink jet printer including the steps of transferring an image from an intermediate transfer member to an obverse side of the print media and applying a drag force to a reverse side of the print media.

An advantage of the present invention is that the print media is removed from an intermediate transfer drum without contacting the printed image.

Another advantage of the present invention is that there are no detack fingers riding on the surface of the drum, thereby reducing wear on the drum.

Yet another advantage of the present invention is that it eliminates image smearing as the print media is removed from an intermediate transfer drum.

Yet still another advantage of the present invention is that a drag force may be applied to a reverse side of a print media in a no-print zone.

An additional advantage of the present invention is that a drag force may be applied to a reverse side of a print media by varying the coefficient of friction or a nip force at the nip.

A further advantage of the present invention is that a drag force may be applied downstream from a nip by either a roll or a belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
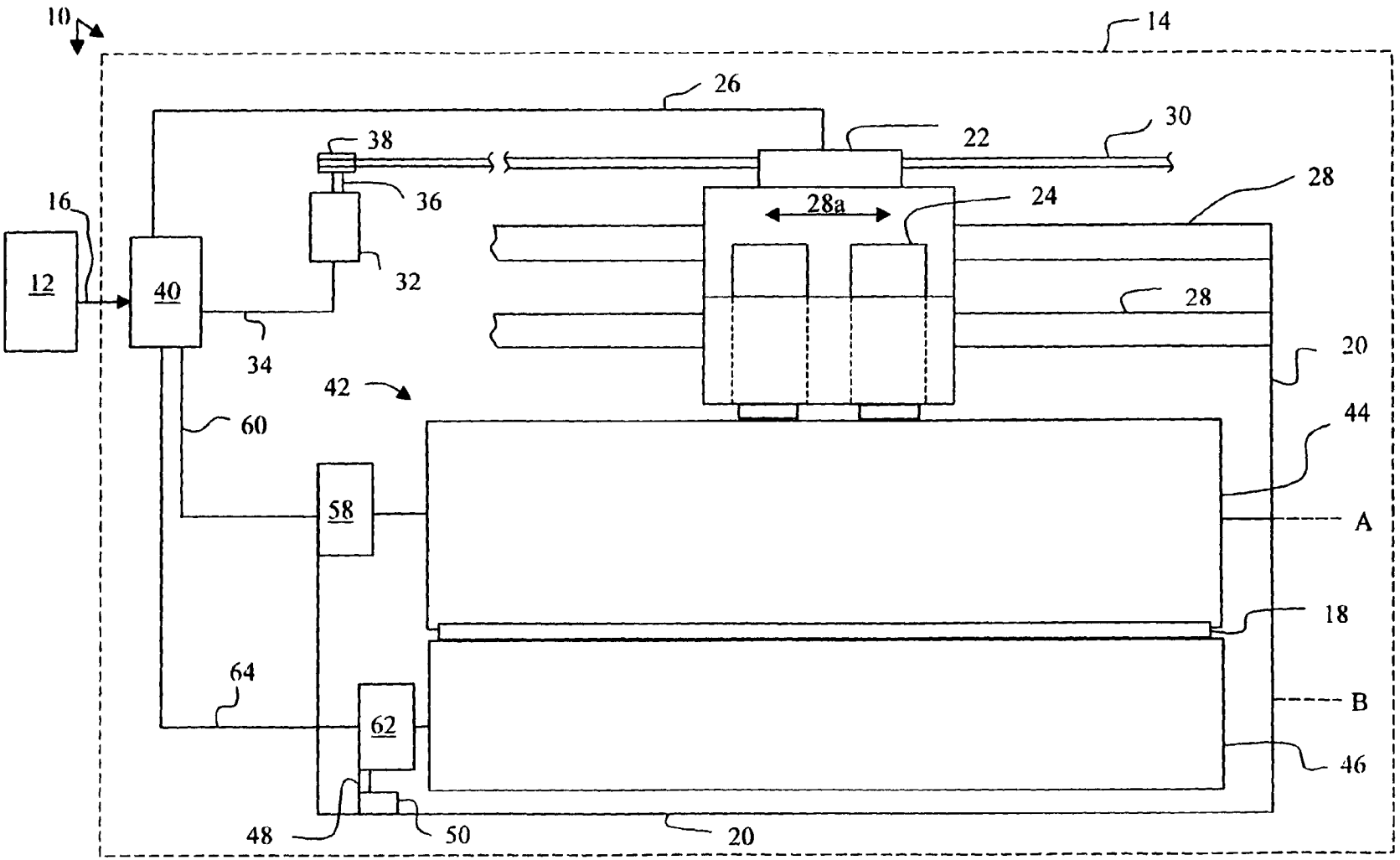
FIG. 1 is a diagrammatic representation of an imaging system having a printer with an embodiment of the present invention.
Figure 2:
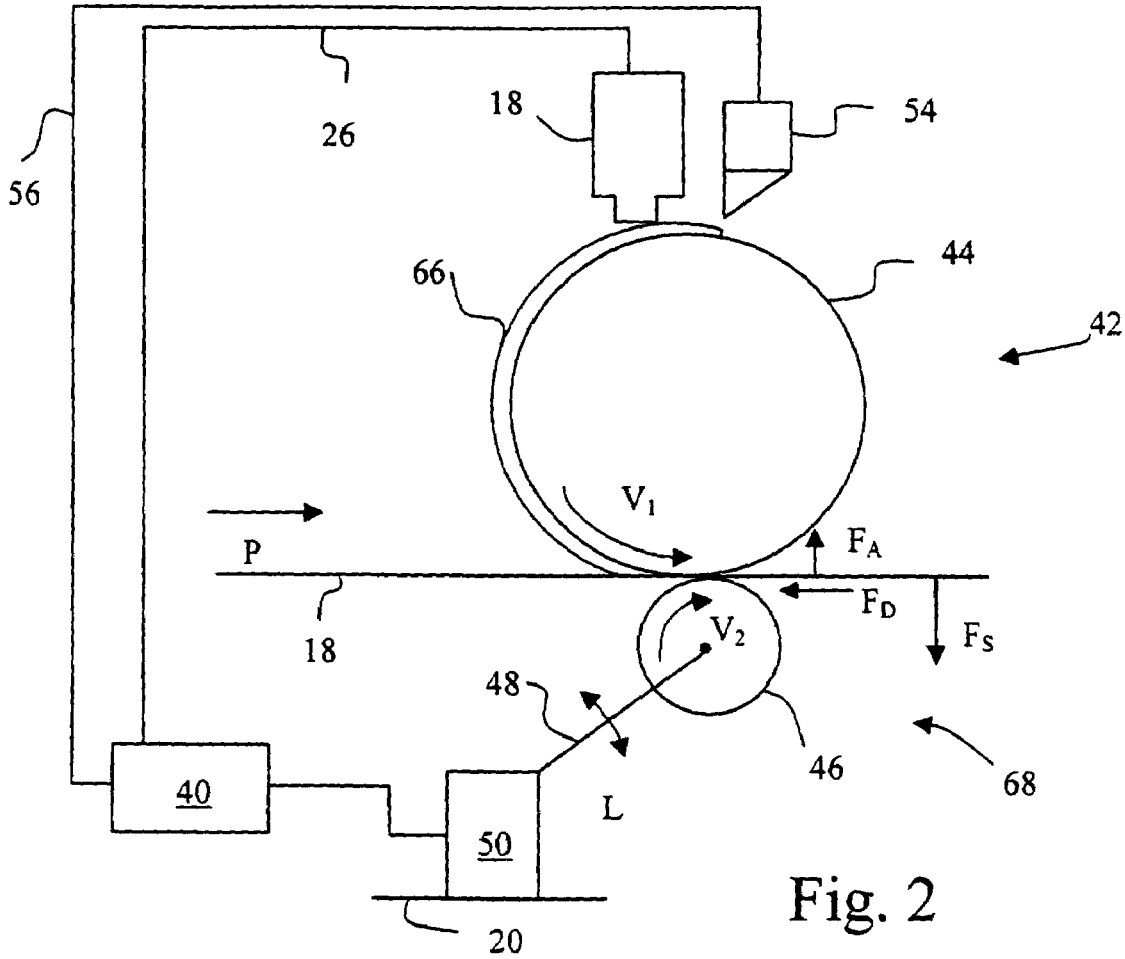
FIG. 2 is a side diagrammatic representation of a rotating drag force applicator of the printer of FIG. 1.

Referring now to the drawings, and more particularly to FIGS. 1 and 2, there is shown an imaging system 10 embodying the present invention. Imaging system 10 includes a computer 12, a printer 14 and a communications link 16. Computer 12 is communicatively coupled to printer 14, which may be in the form of an ink jet printer 14, by way of communications link 16. Communications link 16 may be, for example, an electrical, an optical or a network connection. Computer 12 is typical of that known in the art, and includes a display, an input device such as a keyboard, a processor and associated memory. Resident in the memory of computer 12 is printer driver software. The printer driver software places print data and print commands in the format that is recognizable by ink jet printer 14. The print data and print commands are conveyed to printer 14 by way of communications link 16. Ink jet printer 14 responds to the print data and print commands conveyed to it from computer 12 and prints an image that is ultimately placed upon print media 18.

Ink jet printer 14 includes a frame 20, a carrier 22, printheads 24, a communications link 26, guide rods 28, a carrier transport belt 30, a carrier motor 32, a communications link 34, a carrier motor shaft 36, a driven pulley 38, a controller 40 and a transfer system 42.

Carrier 22 slides along the pair of guide rods 28 controllably carrying printheads 24 in directions 28A. Directions 28A are associated with guide rods 28 and define a bi-directional printing path of printheads 24. Carrier 22 is connected to transport belt 30 that is driven by carrier motor 32 by way of driven pulley 38 connected to carrier motor shaft 56. The speed and the direction of rotation of carrier motor shaft 36 is under the direction of controller 40.

Printheads 24 are controllably moved and fired under the direction of controller 40. Communications link 26 communicatively couples controller 40 and printheads 24. Printheads 24 may include a black ink printhead and a color ink printhead.

Carrier motor 32 includes a rotatable carrier motor shaft 36, which is attached to driven pulley 38 that provides movement to carrier transport belt 30. Carrier motor 32 is communicatively linked to controller 40 by way of communications link 34. Controller 40 directs the velocity and the direction of rotation of motor 32, which may be a servomechanism, a D.C. motor or a stepper motor.

Controller 40 includes a processor and associated memory for coordinating the operations of ink jet printer 14. At a directive of controller 40, carrier 22 is transported in a reciprocated manner along guide rods 28. Controller 40 is communicatively linked to computer 12, printheads 24, carrier motor 32, arm actuators 50 and 76, drum motor 58, transfer roller motor 62, and retarder drives 74 and 86. Controller 40 coordinates the movements and actuations in each of these devices and receives information from sensors (not shown).

Transfer system 42 includes an intermediate transfer member 44, a transfer roller 46, a support arm 48, an arm actuator 50, a communications link 52, a fluid/gel applicator 54, a communication link 56, a drum motor 58, a communication link 60, a transfer roller motor 62, a communication link 64 and a rotating drag force applicator 68.

Intermediate transfer member 44 may be embodied as an intermediate transfer belt or as an intermediate transfer drum 44. Intermediate transfer drum 44 is rotatably mounted to frame 20 about axis 'A'. Intermediate transfer drum 44 is driven by drum motor 58 in a rotational manner. Fluid/gel applicator 54 is located proximate to intermediate transfer drum 44 for applying a coating of a fluid and/or gel 66 thereto. Once the coating of fluid/gel 66 is applied to intermediate transfer drum 44, printhead 24 prints an image thereon, under the control of controller 40. Intermediate transfer drum 44 and transfer roller 46 are located proximate to each other to effect the transfer of the image, placed upon fluid/gel 66, to print media 18.

Transfer roller 46 is pivotally and rotatably connected to frame 20. Transfer roller 46 is oriented to rotate about an axis 'B'. Axis 'B' and axis 'A' are substantially parallel to each other, thereby allowing the rotation of intermediate transfer drum 44 and transfer roller 46 to be coordinated for the movement of print media 18 and for the transfer of the image and gel 66 thereto. Transfer roller 46 is controllably rotated about an end of support arm 48 by transfer roller motor 62. Support arm 48 is pivotally connected to frame 20 and is moveable in directions L by arm actuator 50. Arm actuator 50 positions support arm 48 such that transfer roller 46 is either engaged or disengaged with intermediate transfer drum 44. Once a leading edge of print media 18 is located between intermediate transfer drum 44 and transfer roller 46, arm actuator 50 moves transfer roller 46 into the engaged position. Advantageously, support arm 48 moves transfer roller 46 so as to not come into contact with fluid/gel 66 by positioning transfer roller 46 in the disengaged position when there is no print media 18 present. Arm actuator 50 is under the control of controller 40 by way of communications link 52. Controller 40 communicates with arm actuator 50, thereby coordinating the movement of support arm 48 in the direction shown by arrows L. As support arm 48 moves transfer roller 46 axes A and B remain substantially parallel.

Fluid/gel applicator 54 is under the control of controller 40 by way of communications link 56. Fluid/gel 66 is controllably deposited on intermediate transfer drum 44. Fluid/gel 66 receives an image from printheads 24 and both fluid/gel 66 and the image are transferred to an obverse side of print media 18 by the interaction of intermediate transfer drum 44 and transfer roller 46.

Figure 3:
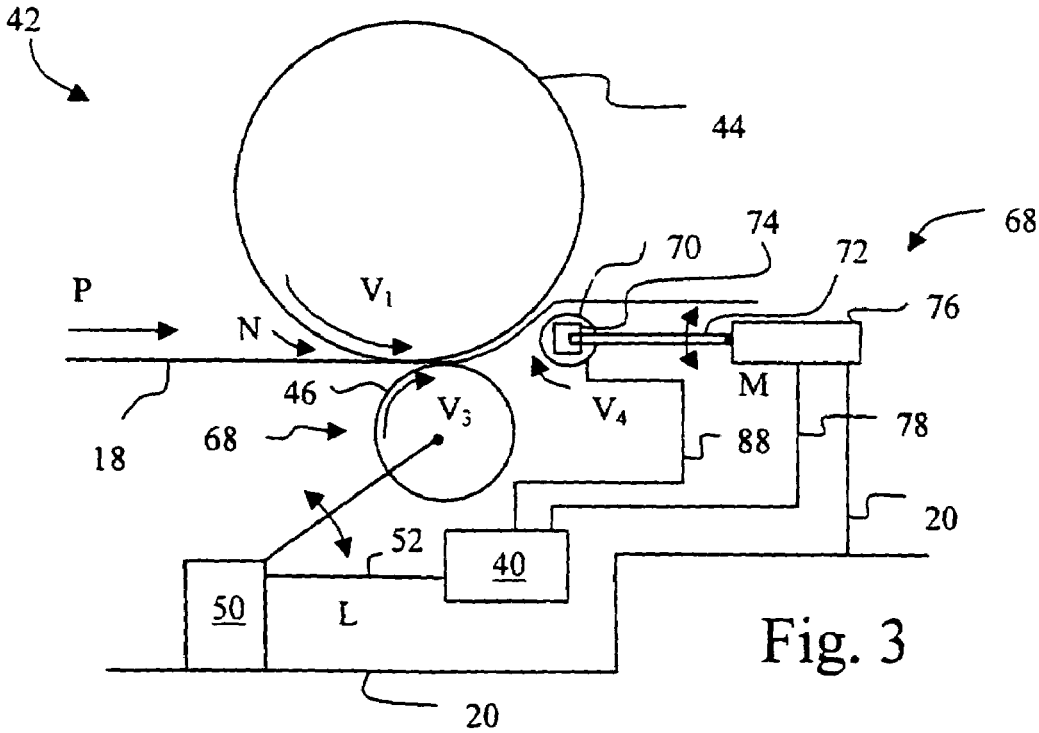
FIG. 3 is a side diagrammatic representation of another embodiment of the rotating drag force applicator of the printer of FIG. 1.
Figure 4:
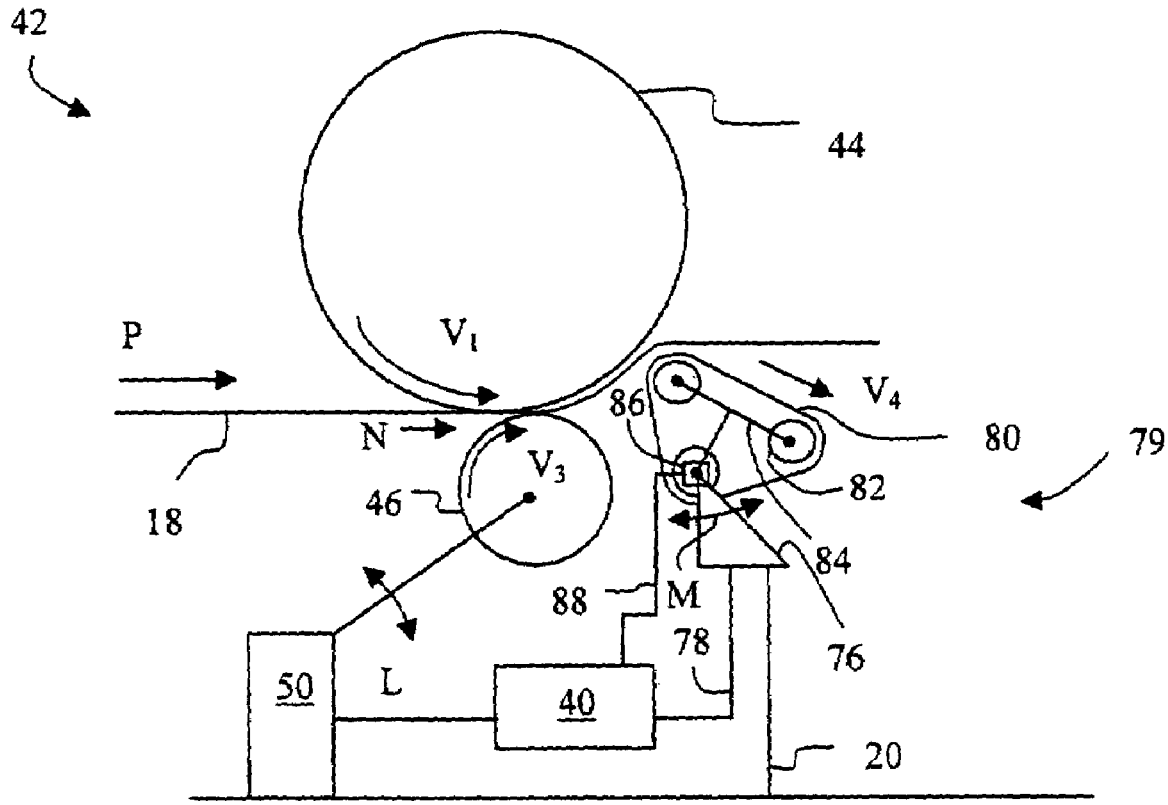
FIG. 4 is a side diagrammatic representation of yet another embodiment of the rotating drag force applicator of the printer of FIG. 1.

Drum motor 58 drives and controls the rotational speed of intermediate transfer drum 44. Intermediate transfer drum 44 has a surface velocity $V_1$, which is associated with the rotational speed of drum motor 58. Drum motor 58 is under the control of controller 40 by way of communications link 60. Communications link 60 transfers commands to drum motor 58 for the controllable rotation of intermediate transfer drum 44. Transfer roller motor 62 controls the speed and direction of the angular velocity of transfer roller 46. Transfer roller 46 has a surface velocity $V_2$ as depicted in FIG. 2 or $V_3$ as shown in FIGS. 3 and 4. Alternatively, transfer roller 46 may have a compressible surface having a Poisson ratio of between 0.0 and 0.3. Such a surface can create an under-driven situation that serves to detack print media 18 from the surface of intermediate transfer drum 44.

Now, additionally referring to FIG. 3, there is shown a rotating drag force applicator 68, also known as retarding device 68, includes retarding roller 70, a roller arm 72, a retarder drive 74, an arm actuator 76 and a communications link 78 as shown in FIG. 3. Alternatively, rotating drag force applicator 68 may be as shown in FIG. 4, which includes a retarding belt 80, rollers 82, a support 84, a retarder drive 86 and a communications link 88.

Retarding roller 70 is rotatably controlled by retarder drive 74, under the direction of controller 40 by way of communication link 88. Retarding roller 70 has a surface velocity of $V_4$, which is controlled by controller 40 to be less than surface velocities $V_1$ and $V_3$. Retarding roller 70 may have a compressible surface that has a Poisson ratio of greater than 0.0 and less than 0.3. The surface of retarding roller 70 creates a frictional contact with a reverse side of print media 18. Roller arm 72 is connected to roller 70 along an axis substantially parallel to axes A and B. Roller arm 72 is pivotally controlled by arm actuator 76 in a direction that is illustrated by arrows M. Controller 40 communicates with arm actuator 76 by way of communications link 78 thereby moving roller 70 into an engaged or disengaged position relative to intermediate transfer drum 44. When in a disengaged position, retarding roller 70 is located apart from intermediate transfer drum 44. When print media 18 is proximate to retarding roller 70 actuator 76 is activated by controller 40, so that roller 70 moves to an engaged position, thereby engaging a reverse side of print media 18, this presses the obverse side of print media 18 against intermediate transfer drum 44. Surface velocity $V_4$ is less than surface velocity $V_1$ and $V_3$ causing print media 18 to curve away from intermediate transfer drum 44, thereby detacking print media 18 from intermediate transfer drum 44.

Now, additionally referring to FIG. 4, there is shown an embodiment of the present invention including rotating drag force applicator 79 that engages print media 18. Retarding belt 80 is driven at surface velocity $V_4$ around rollers 82 by retarder drive 86. Rollers 82 are held in position by support 84. Support 84 is pivotally movable, in a direction indicated by arrows M, by actuator 76, which positions rotating drag force applicator 79 in either an engaged or a disengaged position relative to print media 18. Retarder drive 86 is under the direction of controller 40 by way of communications link 88. Rotating drag force applicator 79 can be pivotally moved to engage print media 18, thereby detacking print media 18 from intermediate transfer drum 44.

As print media 18 moves in direction P, as shown in FIG. 2, certain forces operate on print media 18. Fluids/gel 66 and ink from printhead 24 contacts print media 18, upon entering a nip N formed by the proximate location of intermediate transfer drum 44 and transfer roller 46. In this embodiment transfer roller 46 is also a rotating drag force applicator 46. As print media 18 passes through nip N, in direction P, fluid/gel 66 adheres to print media 18, thereby transferring an image placed upon fluid/gel 66 by printhead 24, to print media 18. The adhesive tendency of fluid/gel 66 that causes print media 18 to adhere to the surface of intermediate transfer drum 44 is diagrammatically depicted as force $F_a$ known as adhesion force $F_a$. Countering the propensity of print media 18 to remain adhered to transfer drum 44 is the natural stiffness of print media 18 diagrammatically depicted as stiffness force $F_s$. Stiffness force $F_s$ is highly dependent upon the nature of print media 18. When print media 18 is of a thicker stock, stiffness force $F_s$ is sufficient to overcome adhesion force $F_a$. However, thinner paper that has a lower stiffness force $F_s$ is insufficient to overcome adhesion force $F_a$. In order to print on print media 18 of various thicknesses the present invention provides a detack force $F_d$ also known as drag force $F_d$, which is a force that co-acts with stiffness force $F_s$ to counter adhesion force $F_a$.

In the embodiment of the present invention that is illustrated in FIG. 2, drag force $F_d$ is generated by controlling surface velocity $V_2$ of transfer roller 46 to be less than surface velocity $V_1$ of transfer drum 44. This difference in velocities creates drag force $F_d$ that causes print media 18 to pull away from intermediate transfer drum 44. Surface velocity $V_2$ of transfer roller 46 is controlled by controller 40 by way of transfer roller motor 62. Transfer motor 62 can provide a braking force as well as a controlled rotation to vary surface velocity $V_2$ to an optimal point where adhesion force $F_a$ is overcome but drag force $F_d$ is controlled so that it is not extreme enough to cause print media 18 to stop moving or to smear the image on fluid/gel 66 as it is transferred to print media 18. Alternatively, the surface of transfer roller 46 may be of a compressible nature, having a Poisson ratio of between 0.0 and 0.3. This type of surface tends to under-drive, thereby providing drag force $F_d$.

In the embodiment of the present invention illustrated in FIG. 3, rotating drag force applicator 68 is depicted as separate from transfer roller 46. Surface velocity $V_3$ is substantially equal to surface velocity $V_1$. This advantageously allows the transfer of the image placed upon fluid/gel 66 to be consummated at nip N and for a short time thereafter, thereby allowing drag force $F_d$ to be supplied downstream from nip N. This allows fluid/gel 66 a short time to bond with print media 18. A short distance beyond nip N rotating drag force applicator 68 is positioned in a disengaged position. When the leading edge of print media 18 has traveled sufficiently through and beyond nip N, then rotating drag force applicator 68 engages print media 18 by rotating into an engaged position against the reverse side of print media 18. The engagement of print media 18 by rotating drag force applicator 68 also forms a nip between rotating drag force applicator and intermediate transfer member 44. Retarding roller 70 is driven by retarding drive 74 at surface velocity $V_4$, which is a lesser velocity than surface velocities $V_1$ and $V_3$. This reduced surface velocity $V_4$ imparts drag force $F_d$ onto print media 18, which in addition to stiffness force $F_s$ causes print media 18 to disengage from intermediate transfer drum 44 and travel toward a paper exit (not shown) of printer 14. As the trailing edge of print media 18 travels through nip N actuator 50 moves transfer roller 46 into a disengaged position relative to intermediate transfer drum 44. In a like manner, as the trailing edge of print media 18 travels past retarding roller 70, arm actuator 76 rotates rotating drag force applicator 68 into the disengaged position. By disengaging transfer roller 46 and rotating drag force applicator 68 from being proximate to intermediate transfer drum 44, material on intermediate transfer drum 44 is not transferred to roller 46 or roller 70.

In the embodiment of the present invention illustrated in FIG. 4, rotating drag force applicator 79 is, as in the previous embodiment, depicted as separate from transfer roller 46. Surface velocity $V_3$ is substantially equal to surface velocity $V_1$. This advantageously allows the transfer of the image placed upon fluid/gel 66 to be consummated at nip N and for a short time thereafter, thereby allowing drag force $F_d$ to be supplied downstream from nip N. This allows fluid/gel 66 a short time to bond with print media 18. A short distance beyond nip N rotating drag force applicator 79 is positioned in a disengaged position. When the leading edge of print media 18 has traveled sufficiently through and beyond nip N, then rotating drag force applicator 79 engages print media 18 by rotating into an engaged position against the reverse side of print media 18. Retarding belt 80 is driven by retarding drive 86 at surface velocity $V_4$, which is a lesser velocity than surface velocities $V_1$ and $V_3$. This reduced surface velocity $V_4$ imparts drag force $F_d$ onto print media 18, which in addition to stiffness force $F_s$ causes print media 18 to disengage from intermediate transfer drum 44 and travel toward a paper exit (not shown) of printer 14. As the trailing edge of print media 18 travels through nip N actuator 50 moves transfer roller 46 into a disengaged position relative to intermediate transfer drum 44. In a like manner, as the trailing edge of print media 18 travels past retarding belt 80, arm actuator 76 rotates rotating drag force applicator 79 into the disengaged position. By disengaging transfer roller 46 and rotating drag force applicator 79 from being proximate to intermediate transfer drum 44, material on intermediate transfer drum 44 is not transferred to roller 46 or belt 80.

Detack force $F_d$ is applied along the width of print media 18 over a short distance in the direction of travel of print media 18. The small area on which detack force $F_d$ is applied is also known as a contact force line. It is along the contact force line that adhesion force $F_a$, stiffness force $F_s$ and detack force $F_d$ interact to detack print media 18 from intermediate transfer member 44. In the embodiment shown in FIG. 2 the contact force line is proximate to nip N. Thus there is an interaction of print media 18 receiving an image on the obverse side while drag force $F_d$ is being applied to the reverse side of print media 18. The area in which the image is applied is known as a print zone. In contrast in the embodiments illustrated in FIGS. 3 and 4 the contact force line is downstream of nip N in an area away from the print zone, known as a no-print zone. Thereby separating the application of the image to print media 18 at nip N and the application of detack force $F_d$ at the contact force line associated with rotating drag force applicator 68 or 79.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer for printing on a print medium having an obverse side, comprising:

a rotating intermediate transfer member for receiving a print image and transferring the print image to the obverse side of the print medium; and a rotating drag force applicator located proximate to and defining a nip with said intermediate transfer member, said drag force applicator being configured for applying a sufficient drag force to the reverse side of the print medium in said nip so as to detack the print medium from said intermediate transfer member while not impairing print quality wherein said drag force results from said rotating drag force applicator having a surface velocity that is less than a surface velocity of said rotating intermediate transfer member.

2. The ink jet printer of claim 1, wherein said rotating drag force applicator includes a surface made of a compressible material.

3. The ink jet printer of claim 2, wherein said surface of said rotating drag force applicator has a Poisson ratio of between approximately 0.0 and 0.3.

4. The ink jet printer of claim 1, wherein said intermediate transfer member is an intermediate transfer drum.

5. The ink jet printer of claim 1, further comprising a transfer roller located proximate to said intermediate transfer member thereby forming an other nip.

6. The ink jet printer of claim 5, wherein said drag force applicator is located downstream from said other nip, said drag force applicator including one of a retarding roller and a retarding belt.

7. The ink jet printer of claim 5, wherein said transfer roller has a surface velocity that is substantially equal to a surface velocity of said rotating intermediate transfer member proximate to said other nip.

8. The ink jet printer of claim 7, wherein said drag force applicator controllably engages the print medium proximate said intermediate transfer member.

9. The ink jet printer of claim 8, further comprising a controller which controllably engages the print medium proximate said intermediate transfer member.

10. The ink jet printer of claim 9, wherein said rotating drag force applicator is in said engaged position when said rotating drag force applicator contacts the reverse side of the print medium.

11. The ink jet printer of claim 1, wherein said rotating drag force applicator is a transfer roller.

12. The ink jet printer of claim 11, wherein said transfer roller controllably engages the print medium.

13. The ink jet printer of claim 12, further comprising a controller which controllably positions said transfer roller in one of an engaged position and a disengaged position.

14. The ink jet printer of claim 13, wherein said transfer roller is in said engaged position when said transfer roller contacts the reverse side of the print medium.

15. The ink jet printer of claim 1, further comprising a fluid/gel applicator configured to apply a coating to said intermediate transfer member.

16. An imaging system, comprising:

a computer; and a printer conimunicatively connected to said computer, said printer being configured for printing on a print medium having an obverse side and a reverse side, said printer including:

a rotating intermediate transfer member for receiving a print image and transferring the print image to the obverse side of the print medium; and a rotating drag force applicator located proximate to and defining a nip with said intermediate transfer member, said drag force applicator being configured for applying a sufficient drag force to the reverse side of the print medium in said nip so as to detack the print medium from said intermediate transfer member while not impairing print quality wherein said drag force results from said rotating drag force applicator having a surface velocity that is less than a surface velocity of said rotating intermediate transfer member.

17. The imaging system of claim 16, wherein said rotating drag force applicator includes a surface made of a compressible material.

18. The imaging system of claim 17, wherein said surface of said rotating drag force applicator has a Poisson ratio of between approximately 0.0 and 0.3.

19. The imaging system of claim 16, wherein said intermediate transfer member is an intermediate transfer drum.

20. The imaging system of claim 16, wherein said printer further comprises a transfer roller located proximate to said intermediate transfer member thereby forming an other nip.

21. The imaging system of claim 20, wherein said drag force applicator is located downstream from said other nip, said drag force applicator including one of a retarding roller and a retarding belt.

22. The imaging system of claim 20, wherein said transfer roller has a surface velocity that is substantially equal to a surface velocity of said rotating intermediate transfer member proximate to said other nip.

23. The imaging system of claim 22, wherein said drag force applicator controllably engages the print medium proximate said intermediate transfer member.

24. The imaging system of claim 23, further comprising a controller which controllably positions said rotating drag force applicator in one of an engaged position and a disengaged position.

25. The imaging system of claim 24, wherein said drag force applicator is in said engaged position when said rotating drag force applicator contacts the reverse side of the print medium.

26. The imaging system of claim 16, wherein said rotating drag force applicator is a transfer.

27. The imaging system of claim 26, wherein said transfer roller controllably engages the print medium.

28. The imaging system of claim 27, wherein said printer further comprises a controller which controllably positions said transfer roller in one of an engaged position and a disengaged position.

29. The imaging system of claim 28, wherein said transfer roller is in said engaged position when said transfer roller contacts the reverse side of the print medium.

30. A method of detacking a print medium from an intermediate transfer member in an ink jet printer, comprising the steps of:

transferring an image from an intermediate transfer member to an obverse side of the print medium; and applying a sufficient drag force to a reverse side of the print medium to as to detack said print medium from said intermediate transfer member while not impairing print quality wherein said intermediate transfer member has a first surface velocity, said drag force resulting from a rotating drag force applicator being in contact with a reverse side of the print medium, said drag force applicator having a second surface velocity that is less than said first surface velocity.

31. The method of claim 30, wherein said transferring step is facilitated by a transfer roller being proximate to said intermediate transfer member thereby forming a nip therebetween, said transfer roller having at least a partial surface made of a material having a Poisson ratio from approximately 0.0 to 0.3, said transfer roller applying said drag force to said reverse side of the print medium.

* * * * *